US008833117B2

(12) United States Patent
Yang

(10) Patent No.: US 8,833,117 B2
(45) Date of Patent: Sep. 16, 2014

(54) LOCKING DEVICE

(71) Applicant: Kai-Lang Yang, Taipei (TW)

(72) Inventor: Kuo-Tsung Yang, Taipei (TW)

(73) Assignees: Jin Tay Industries Co., Ltd., New Taipei (TW); Simon Lock Co., Ltd., Taipei (TW)

( * ) Notice: Subject to any disclaimer, the term of this patent is extended or adjusted under 35 U.S.C. 154(b) by 48 days.

(21) Appl. No.: 13/631,059

(22) Filed: Sep. 28, 2012

(65) Prior Publication Data

US 2014/0090428 A1 Apr. 3, 2014

(51) Int. Cl.
*E05B 73/00* (2006.01)
*E05B 69/00* (2006.01)

(52) U.S. Cl.
USPC ..... 70/58; 70/14; 70/57

(58) Field of Classification Search
CPC ... E05B 37/025; E05B 67/003; E05B 67/383; E05B 73/00; E05B 73/005; E05B 73/0017; E05B 73/0082; E05B 2073/00; E05B 2073/0082
USPC ..... 70/14, 22, 30, 57, 58
See application file for complete search history.

(56) References Cited

U.S. PATENT DOCUMENTS

| | | | | |
|---|---|---|---|---|
| 3,765,197 | A * | 10/1973 | Foote | 70/58 |
| 3,859,826 | A * | 1/1975 | Singer et al. | 70/58 |
| 4,107,958 | A * | 8/1978 | Manley, Jr. | 70/58 |
| 5,009,087 | A * | 4/1991 | Long | 70/49 |
| 5,794,463 | A * | 8/1998 | McDaid | 70/58 |
| 6,742,366 | B1 * | 6/2004 | Lai | 70/58 |
| 7,174,752 | B2 * | 2/2007 | Galant | 70/58 |
| 7,299,668 | B1 * | 11/2007 | Lu | 70/58 |
| 7,443,665 | B2 * | 10/2008 | Allen | 361/679.55 |
| 8,074,478 | B1 * | 12/2011 | Shu | 70/58 |
| 2004/0065126 | A1 * | 4/2004 | Yang | 70/58 |
| 2010/0079285 | A1 * | 4/2010 | Fawcett et al. | 70/57.1 |

* cited by examiner

*Primary Examiner* — Christopher Boswell
(74) *Attorney, Agent, or Firm* — patenttm.us

(57) ABSTRACT

A locking device includes a clamp for clamping on one side of a mobile electronic device, a cord member connected to the clamp, and a lock module including a housing, a locating block connected to the housing and movably sleeved onto the other end of the cord member and connectable to an opposite side of the mobile electronic device, a tightening up screw mounted in the locating block, a rotary knob for rotating the tightening up screw to lock the cord member to the locating block, and a rotating disc assembly for locking the rotary knob.

14 Claims, 15 Drawing Sheets

LOCKING DEVICE

BACKGROUND OF THE INVENTION

1. Field of the Invention

The present invention relates to locking technology and more particularly, to a locking device for locking a mobile electronic product.

2. Description of the Related Art

With life being faster, many people are becoming more driven and task oriented. To satisfy the demand for real-time information, mobile electronic devices have become the necessities of people. From notebook to tablet computer and smart phone, these mobile electronic devices play an important role in outer daily life. However, due to high demand, high cost and high mobility, these mobile electronic devices are at a high risk of theft.

In the open spaces of 3C stores, different brands of electronic products are exhibited in tables for demonstration and tests. Locking devices are usually used to protect these exhibiting electronic products against theft. A locking device for this purpose is known comprising a metal cord affixed with its one end to a fixed object, and a lock unit located at an opposite end of the metal cord and lockable to an opening or lock hole at a mobile electronic product, for example, notebook computer. Subject to the constraint of the cord member, the notebook computer can simply be moved within a limited range, lowering the risk of theft.

The aforesaid conventional method can reduce the risk of theft of the exhibiting mobile electronic products. However, the locking devices of the aforesaid design consisting of a metal cord and a lock unit are simply applicable to mobile electronic products that have a specifically designed opening or lock hole. They cannot be used to lock a thin thickness mobile electronic product without the said opening or lock hole. For protecting a thin thickness mobile electronic product, a clamping frame may be used to hold the thin thickness mobile electronic product in place and locked by a lock. It is inconvenient and complicated to protect a thin thickness mobile electronic product against theft in this manner.

SUMMARY OF THE INVENTION

The present invention has been accomplished under the circumstances in view. It is the main object of the present invention to provide a locking device, which is mountable at two opposite sides of a mobile electronic device and insertable into an audio jack or USB jack to lock the mobile electronic device in place.

To achieve this and other objects of the present invention, a locking device comprises a clamp, a cord member, a lock module, and a tightening up screw. The clamp is adapted for clamping on one side of a mobile electronic device, comprising a cord mounting hole horizontally disposed near a bottom side thereof. The cord member has one end thereof fastened to the cord mounting hole of the clamp and an opposite end thereof detachably connectable to the lock module. The lock module is attached to and movable along the opposite end of the cord member, comprising a plug member insertable into an opposite side of the mobile electronic device, a cord insertion hole for the passing of the cord member, and a stepped through hole disposed in communication with the cord insertion hole. The tightening up screw is mounted in the stepped through hole of the lock module and rotatable relative to the stepped through hole toward and away from the cord member in the cord insertion hole between a locking position to hold down the cord member in the cord insertion hole tightly and an unlocking position for allowing the cord member to be moved relative to the lock module.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
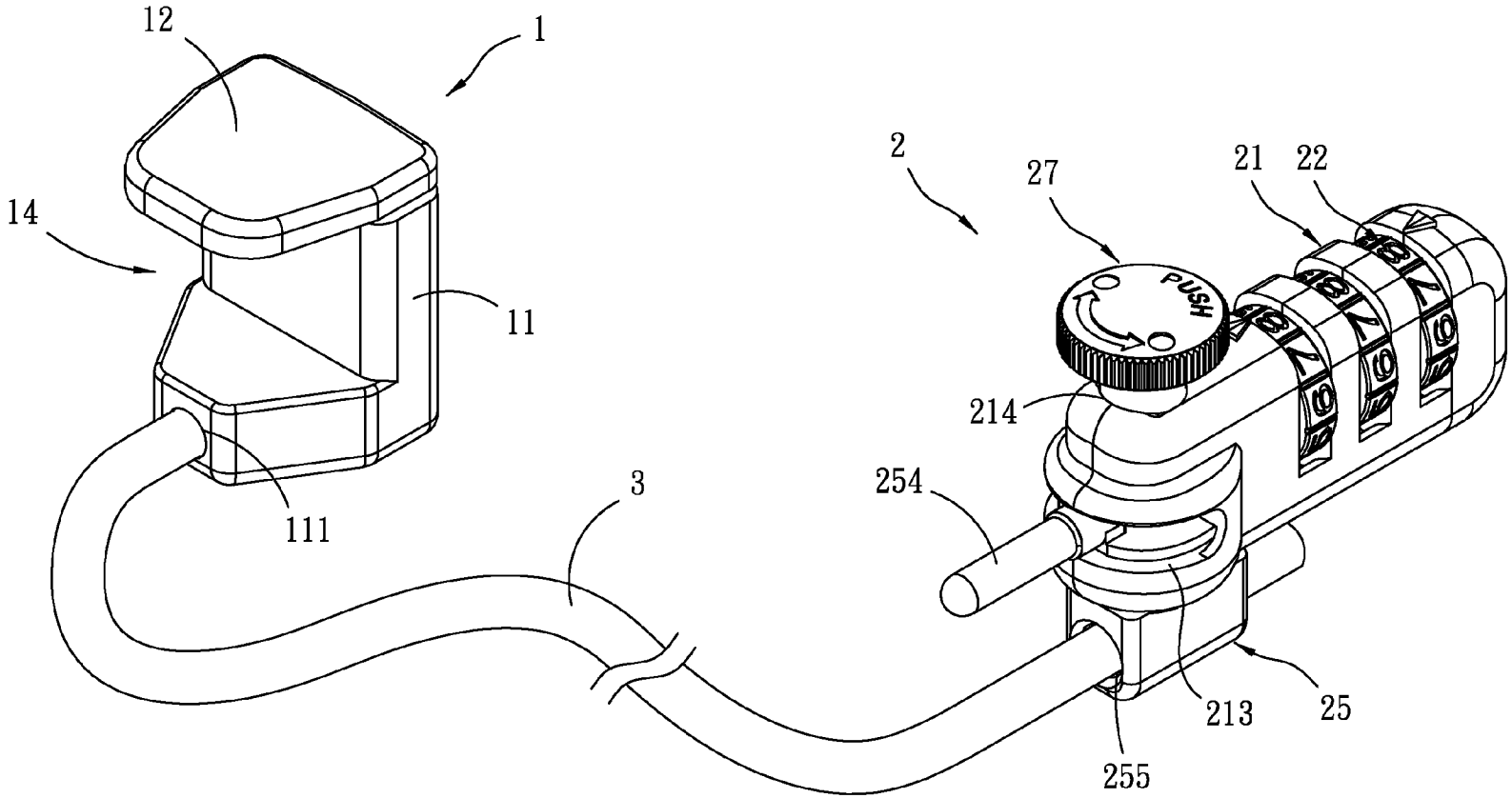
FIG. 1 is an elevational view of a locking device in accordance with a first embodiment of the present invention.
Figure 2:
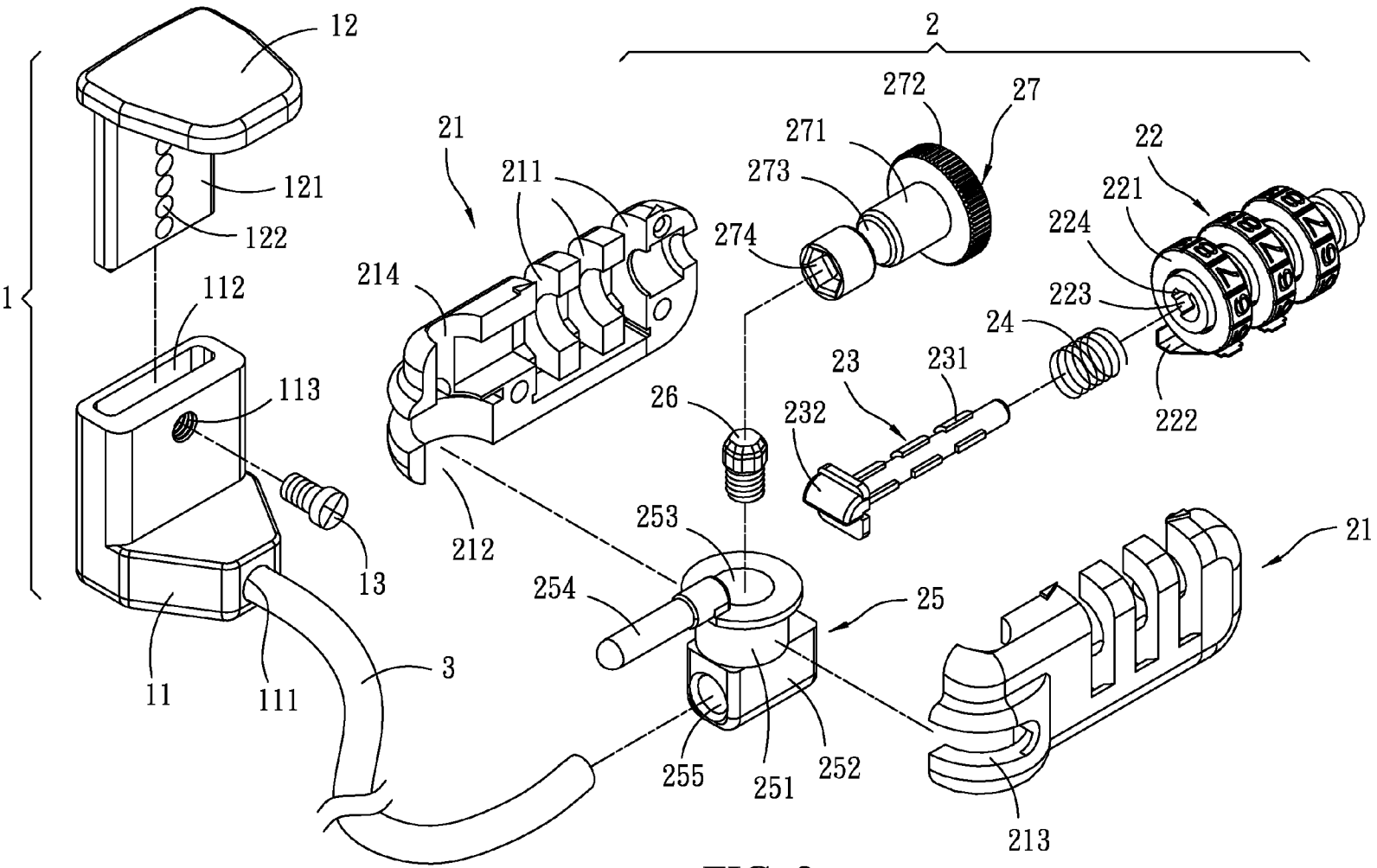
FIG. 2 is an exploded view of the locking device in accordance with the first embodiment of the present invention.

Referring to FIGS. 1 and 2, a locking device in accordance with a first embodiment of the present invention is shown comprising a clamp 1, a lock module 2, and a cord member 3.

The cord member 3 has its one end inserted into the clamp 1, and its other end inserted through the lock module 2.

The clamp 1 comprises a first clamp member 11, a second clamp member 12 and a fastening member, for example, lock screw 13. The first clamp member 11 and the second clamp member 12 both have a substantially L-shaped profile. The first clamp member 11 comprises a cord mounting hole 111 horizontally disposed in a lower part thereof for the mounting of one end of the cord member 3, a vertical insertion slot 112 vertically disposed in an rimmed upper part thereof, and a horizontal through hole, for example, horizontal screw hole 113 extending through a front wall of the rimmed upper part in communication with the vertical insertion slot 112 for the mounting of the lock screw 13. The second clamp member 12 comprises a downwardly extending plug plate 121 for insertion into the vertical insertion slot 112 of the first clamp member 11, and a plurality of recessed holes 122 vertically arranged on a front wall of the downwardly extending plug plate 121 in a line for receiving the front tip of the lock screw 13 selectively to let the second clamp member 12 be locked to the first clamp member 11 in one of a series of vertically spaced positions with a clamping space 14 defined between the first clamp member 11 and the second clamp member 12. Therefore, a height of the clamping space 14 is changed when the lock screw 13 is received in different recessed holes 122.

The lock module 2 comprises a housing 21 formed of two symmetrical halves, a rotating disc assembly 22, a lock pin 23, a spring member 24, a locating block 25, a tightening up screw 26, and a rotary knob 27.

The housing 21 comprises a plurality of wheel seats 211 arranged in parallel and spaced along a longitudinal axis thereof, an accommodation open chamber 212 located at a bottom wall of a front side thereof in front of the wheel seats 211, a shank hole 214 vertically upwardly extended from the accommodation open chamber 212 to a top wall thereof, and a circular sliding slot 213 transversely (horizontally) disposed at the front side in communication between the accommodation open chamber 212 and the shank hole 214. The rotating disc assembly 22 comprises a plurality of rotating discs 221 respectively marked with the ten digits 0 to 9 around the periphery and respectively accommodated in the wheel seats 211 in the housing 21 and rotatable in the respective wheel seats 211 by the user, a set of spring leaves 222 respectively set in the wheel seats 211 and respectively kept in contact with the rotating discs 221 at a bottom side for imparting frictional resistance to the respective rotating discs 221, a lock pin slot 223 axially extending through the center of each of the rotating discs 221, and a plurality of notches 224 respectively located on the respective inner perimeter of the rotating discs 221 in communication with the lock pin slot 223. The rotating discs 221 can be rotated to correspond to the numerals in the correct combination, keeping the notches 224 in alignment. Rotating the rotating discs 221 to adjust the respective positions of the notches 224 is of the known art, and therefore, no further detailed description in this regard is necessary. The lock pin 23 is inserted into the rotating disc assembly 22, comprising a plurality of protruding teeth 231 protruded from the periphery thereof for mating with the notches 224 of the rotating disc assembly 22, and a latch tongue 232 located at one end thereof outside the rotating disc assembly 22. The spring member 24 is a coil spring sleeved onto the lock pin 23 and stopped between the rotating disc assembly 22 and the latch tongue 232 of the lock pin 23.

The locating block 25 is mounted in the front side of the housing 21, comprising a rimmed upper part 251 rotatably coupled to the circular sliding slot 213 of the housing 21 and suspending in the accommodation open chamber 212, a lower part 252 connected to a bottom side of the rimmed upper part 251 and suspending outside the housing 21, a stepped through hole 253 vertically extending through the rimmed upper part 251 and the lower part 252, a cord insertion hole 255 horizontally extending through the lower part 252 across the stepped through hole 253 for the passing of the other end of the cord member 3, and a plug member 254 horizontally extended from the topmost edge of the rimmed upper part 251 through the circular sliding slot 213 to the outside of the housing 21. Further, the stepped through hole 253 defines a small diameter lower end and a big diameter upper end, and the small diameter lower end of the stepped through hole 253 is internally threaded. Further, the plug member 254 in this embodiment is configured subject to the specification of a 3.5 mm audio pin. The tightening up screw 26 is mounted in the stepped through hole 253 and threaded into the internally threaded small diameter lower end of the stepped through hole 253 to lock the other end of the cord member 3 to the lock module 2. The rotary knob 27 comprises a shank 271 inserted into the shank hole 214 of the housing 21, a socket 274 located at one end of the shank 271 and disposed inside the shank hole 214 for rotating the tightening up screw 26, a head 272 located at an opposite end of the shank 271 and disposed outside the housing 21 for operation by the user to rotate the shank 271 and the socket 274, and a neck 273 connected between the shank 271 and the socket 274 and stoppable by the latch tongue 232 of the lock pin 23.

Figure 3:
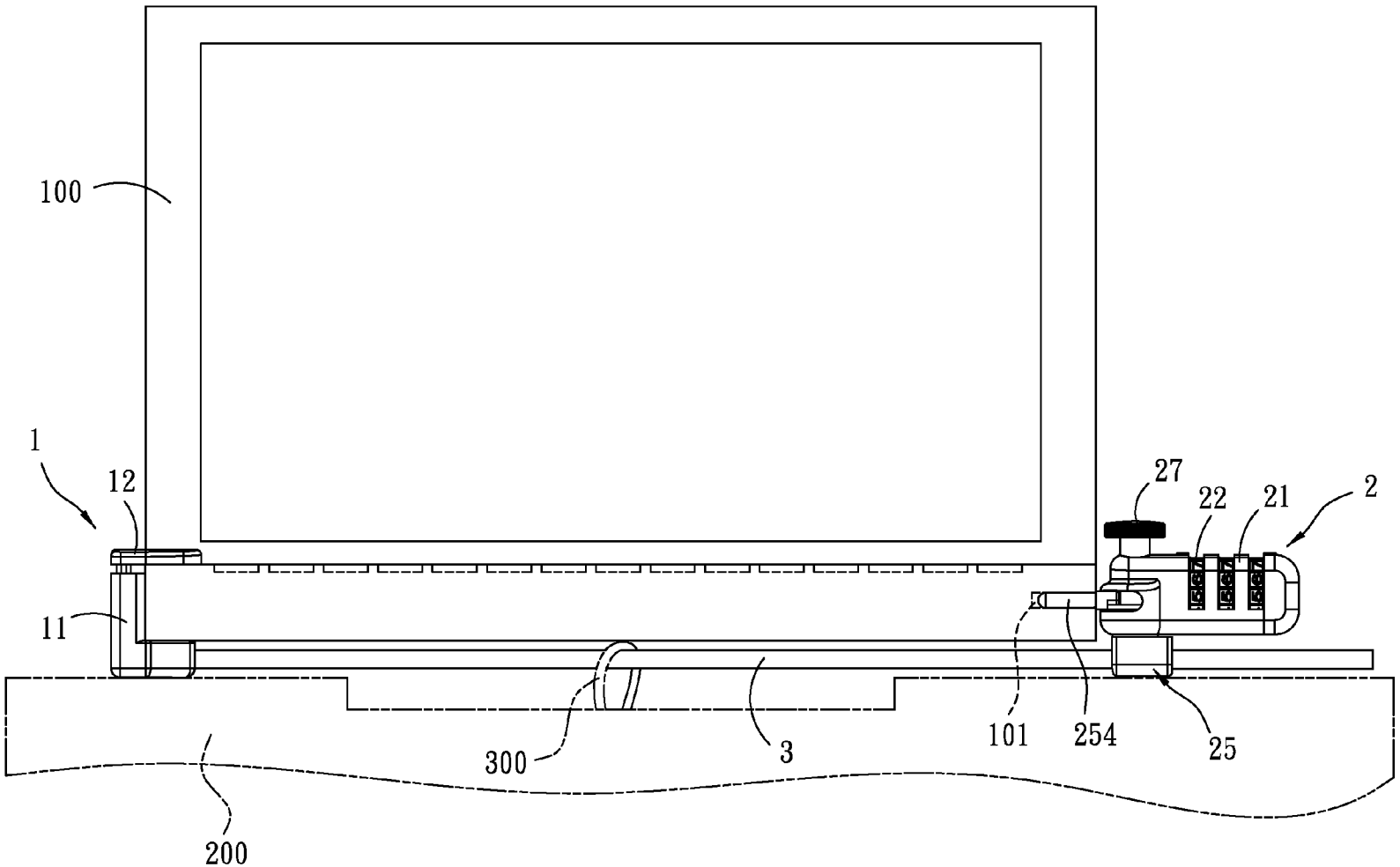
FIG. 3 is a schematic drawing illustrating an operation status of the locking device in accordance with the first embodiment of the present invention (I).
Figure 4:
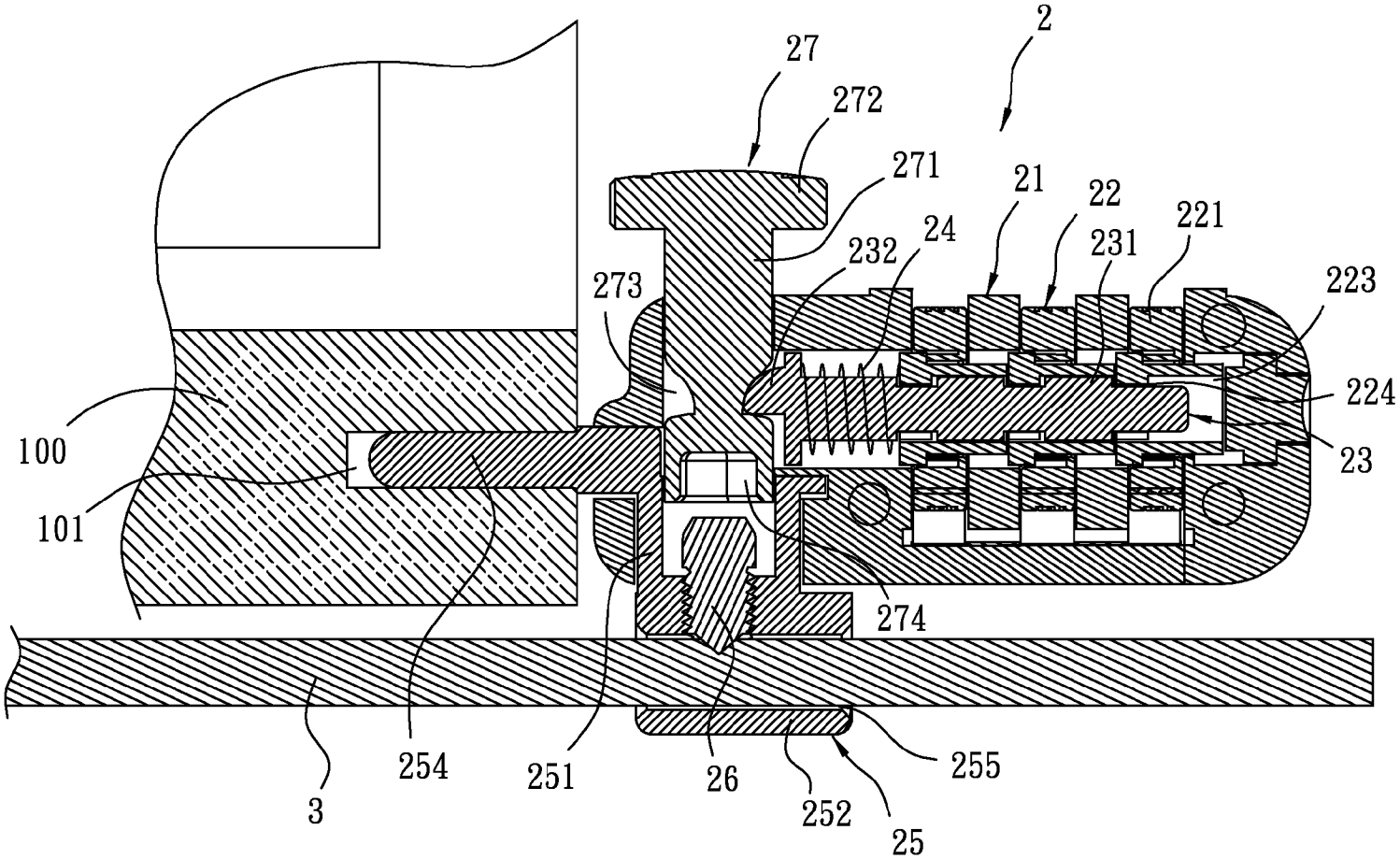
FIG. 4 is a schematic drawing illustrating an operation status of the locking device in accordance with the first embodiment of the present invention (II).
Figure 5:
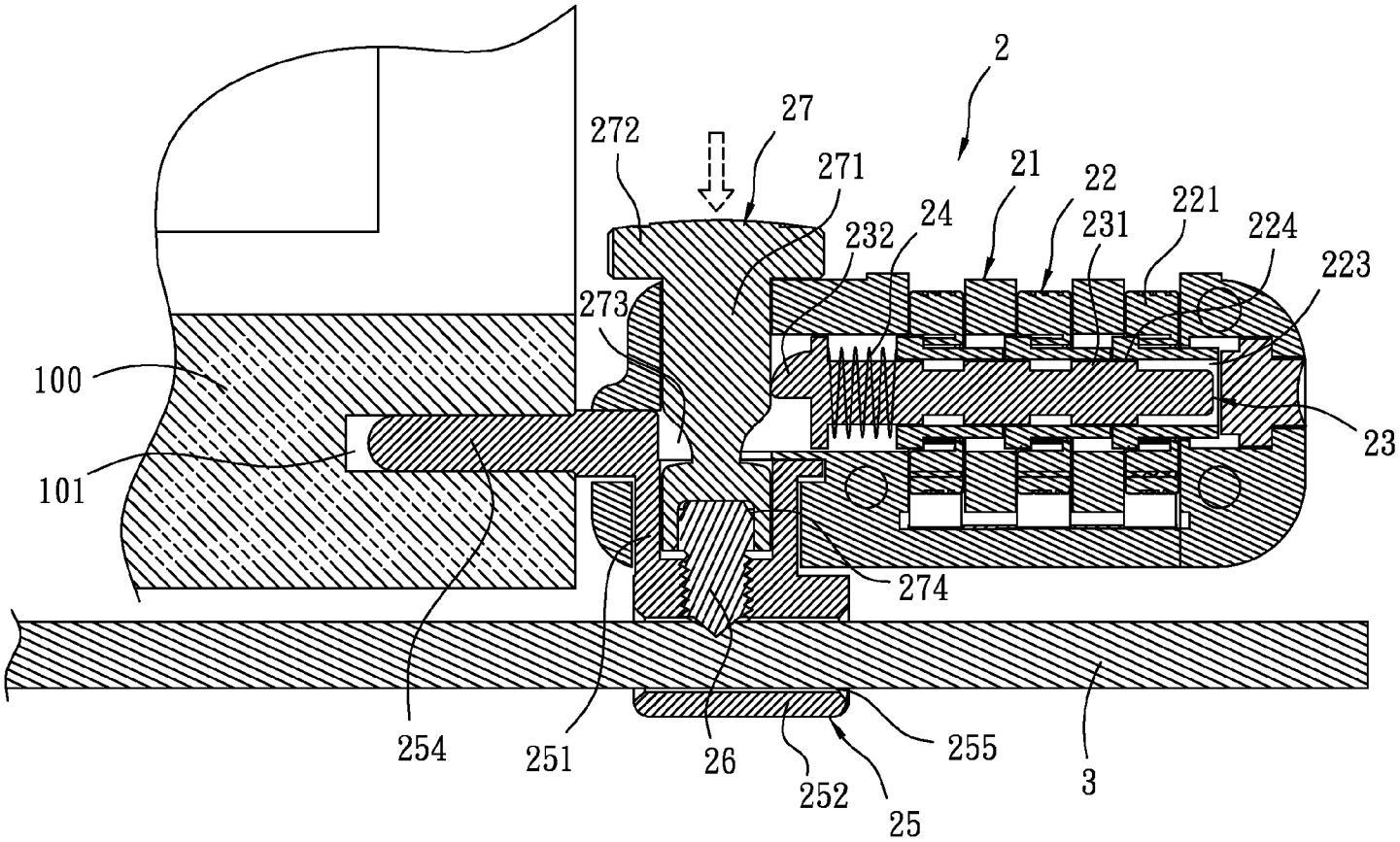
FIG. 5 is a schematic drawing illustrating an operation status of the locking device in accordance with the first embodiment of the present invention (III).
Figure 6:
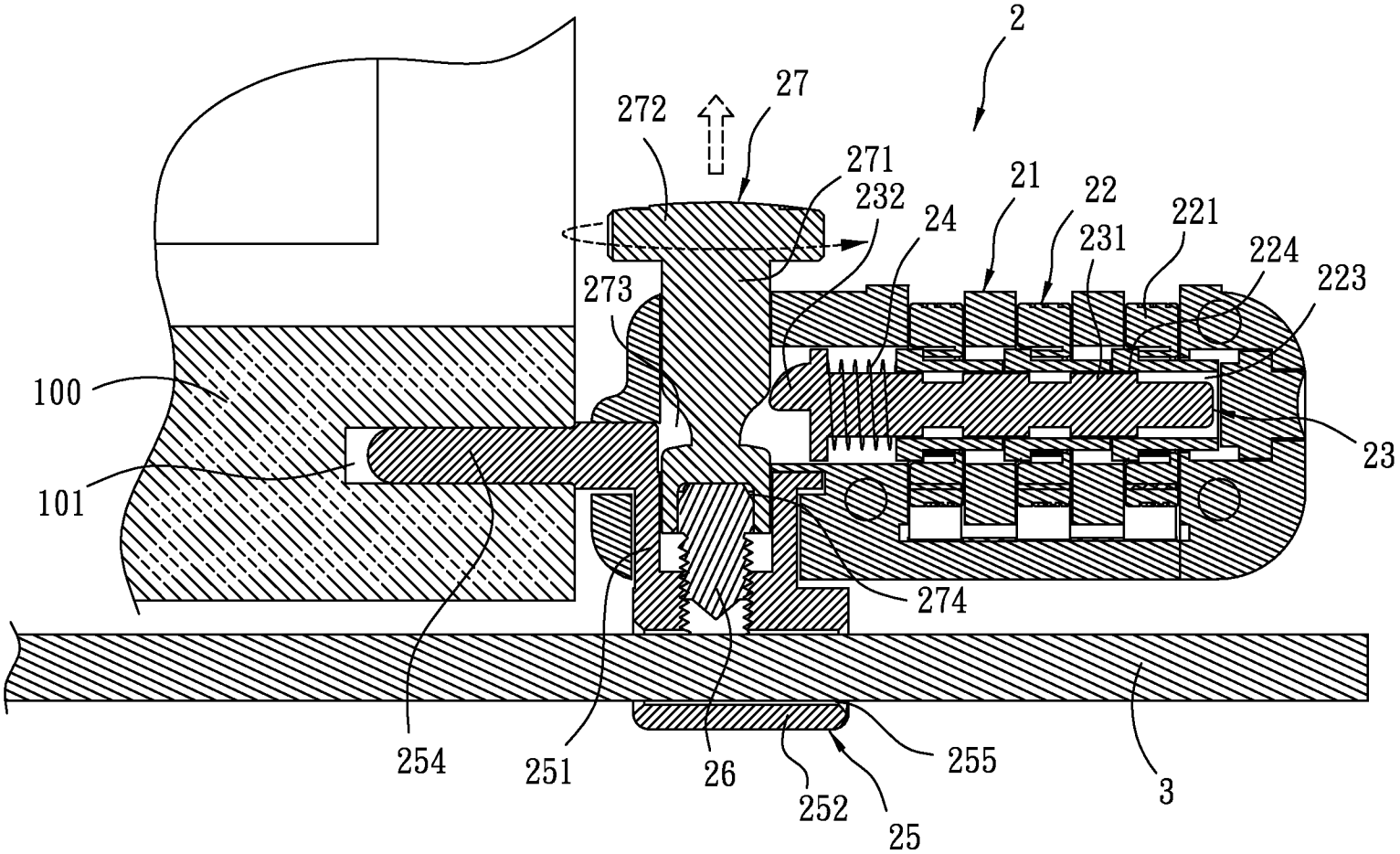
FIG. 6 is a schematic drawing illustrating an operation status of the locking device in accordance with the first embodiment of the present invention (IV).
Figure 7:
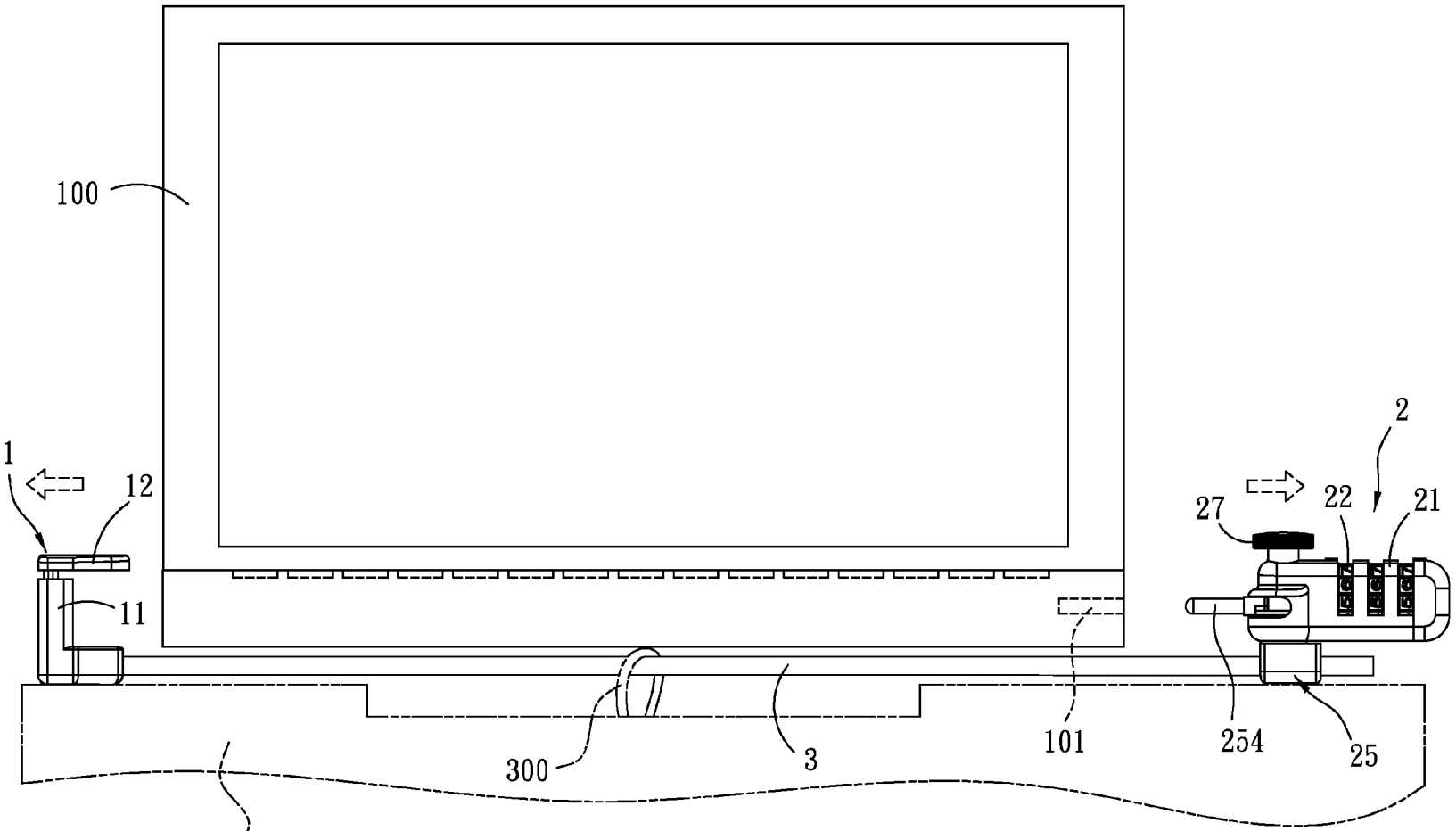
FIG. 7 is a schematic drawing illustrating an operation status of the locking device in accordance with the first embodiment of the present invention (V).

Referring to FIGS. 3-7, the application of the locking device is explained hereinafter. As illustrated in FIG. 3, the clamp 1 is clamped on one side of a computer 100, the plug member 254 of the lock module 2 is inserted into an audio jack 101 at an opposite side of the computer 100, and the cord member 3 is inserted through a concealed passageway 300 in the tabletop 200 that supports the computer 100. At this time, the locking device is in the locked state. When in the locked state, as shown in FIG. 4, the tightening up screw 26 is stopped against the cord member 3 tightly to affix the cord member 3 to the inside of the locating block 25, stopping the computer 100 from being moved relative to the tabletop 200; the latch tongue 232 of the lock pin 23 is stopped against the neck 273 of the rotary knob 27 and the notches 224 in the lock pin slot 223 of the rotating disc assembly 22 are engaged with the respective protruding teeth 231 of the lock pin 23, prohibiting the rotary knob 27 from being moved downward toward the tightening up screw 26, i.e., rotating the rotary knob 27 at this time will run idle. When going to unlock the locking device, as shown in FIG. 5, rotate the rotating discs 221 of the rotating disc assembly 22 to the correct combination to keep the notches 224 in the lock pin slot 223 in alignment with the protruding teeth 231 of the lock pin 23 for allowing the lock pin 23 to be freely movable in and out of the lock pin slot 223, and then press the rotary knob 27 to move the lock pin 23 backwardly toward the inside of the lock pin slot 223 and to force the socket 274 into engagement with the tightening up screw 26, and then rotate the rotary knob 27 to reverse the tightening up screw 26 in direction away from the cord member 3, as shown in FIG. 6, and then move the lock module 2 to carry the plug member 254 away from the audio jack 101 of the computer 100, and then unlock the clamp 1 from the computer 100, as shown in FIG. 7. At this time, the computer 100 is unlocked and can be moved away from the tabletop 200.

Figure 8:
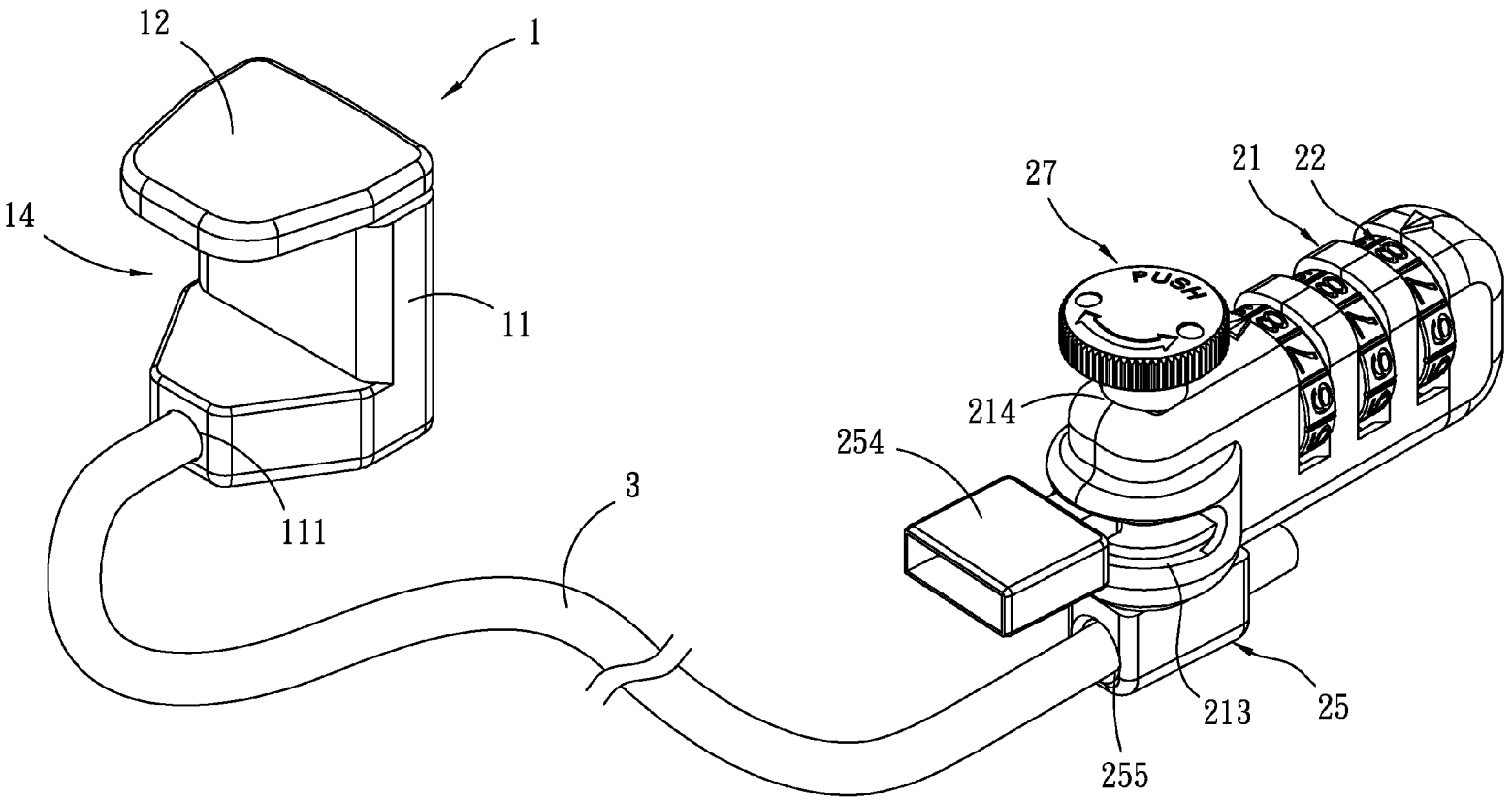
FIG. 8 is an elevational view of a locking device in accordance with a second embodiment of the present invention.

FIG. 8 illustrates a locking device in accordance with a second embodiment of the present invention. This second embodiment is substantially similar to the aforesaid first embodiment with the exception that the plug member 254 according to this second embodiment is configured subject to the specification of a USB plug for insertion into a USB jack.

Figure 9:
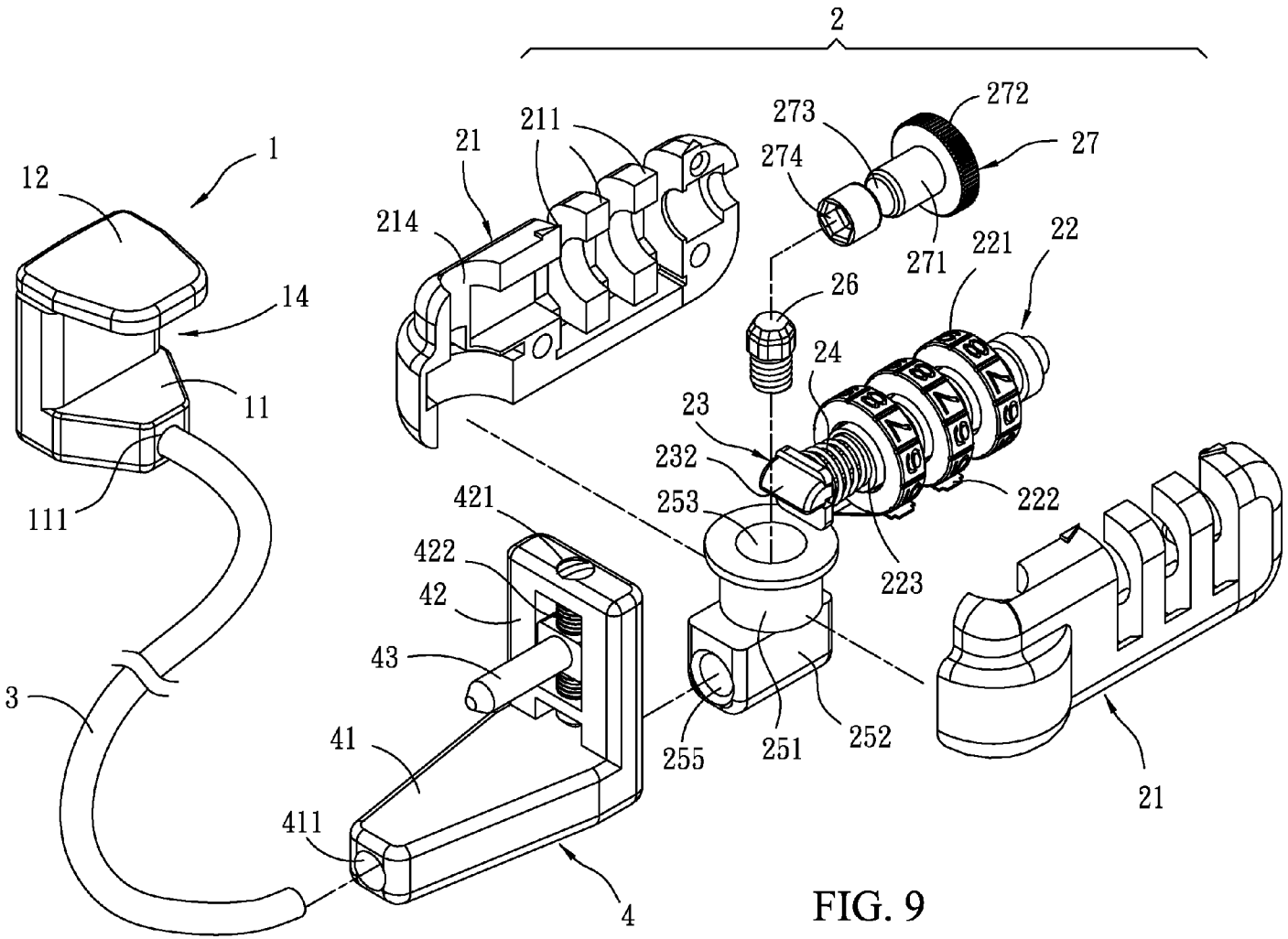
FIG. 9 is an exploded view of a locking device in accordance with a third embodiment of the present invention.

FIG. 9 illustrates a locking device in accordance with a third embodiment of the present invention. According to this third embodiment, the plug member and the locating block are separately arranged, preventing the plug member from being destroyed by an evil person. As illustrated, this third embodiment further comprises a connection device 4 having a substantially L-shaped profile and set between the clamp 1 and the lock module 2. The connection device 4 comprises a base member 41, a horizontal cord hole 411 extending through two opposing ends of the base member 41 for the passing of the cord member 3, an upright member 42 perpendicularly upwardly extended from one end of the base member 41, a mounting screw hole 421 vertically formed in the upright member 42 and extending to the topmost edge of the upright member 42, a horizontal plug member 43 configured subject to the specification of a 3.5 mm audio pin and coupled to and movable along the upright member 42, and an adjustment screw 422 mounted in the mounting screw hole 421 and threaded through one end of the plug member 43 to secure the plug member 43 to the upright member 42, holding the plug member 43 in horizontal. By means of rotating the adjustment screw 422, the plug member 43 is moved vertically along the upright member 42 to the desired elevation.

Figure 10:
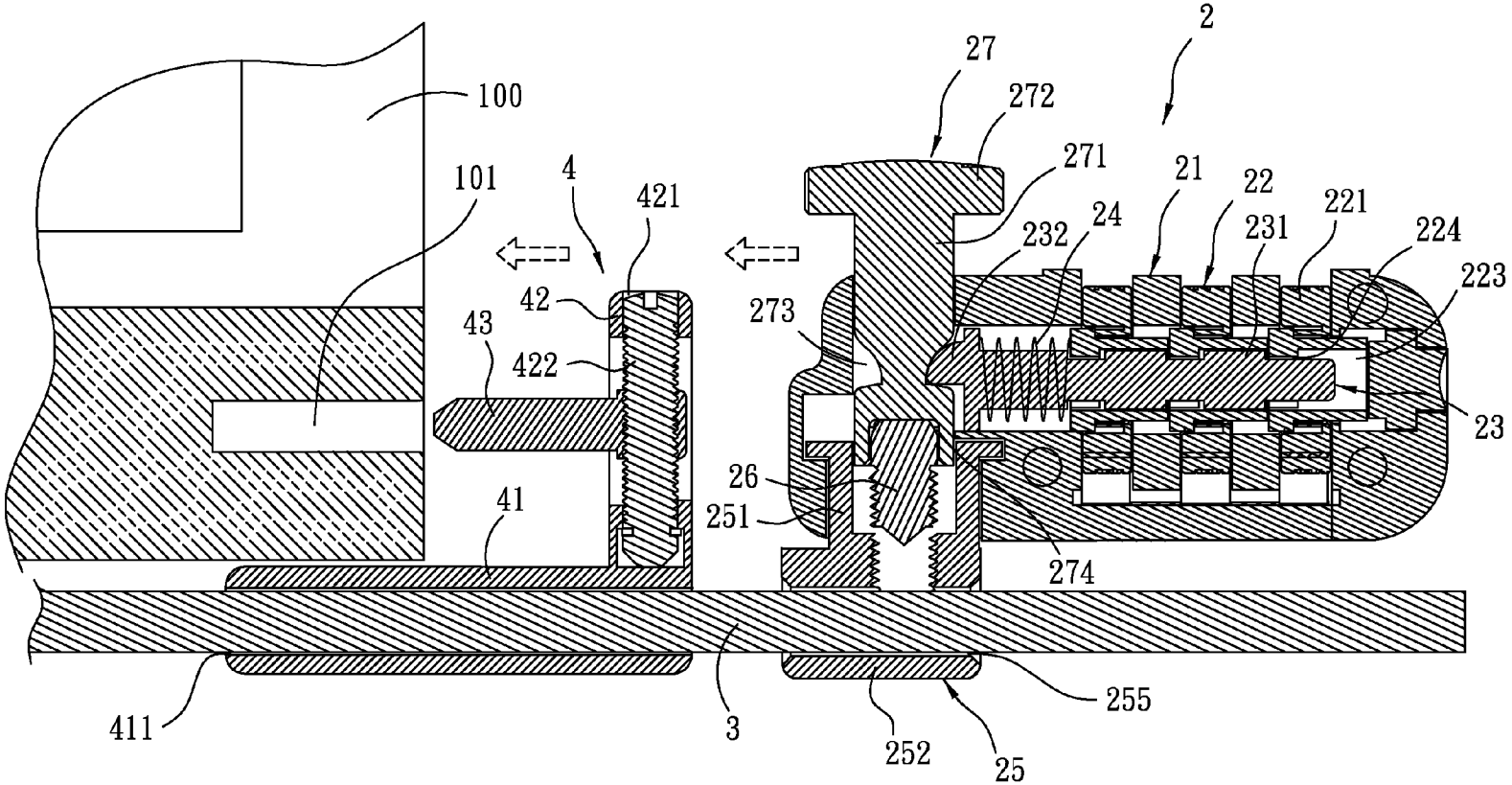
FIG. 10 is a schematic drawing illustrating an operation status of the locking device in accordance with the third embodiment of the present invention.

Referring to FIG. 10, the application of the locking device in accordance with the third embodiment is outlined hereinafter. As illustrated, after insertion of the cord member 3 through the horizontal cord hole 411 of the base member 41, rotate the adjustment screw 421 to adjust the elevation of the plug member 43 subject to the elevation of the audio jack 101 of the computer 100, and then insert the plug member 43 of the connection device 4 into the audio jack 101 of the computer 100, and then insert the cord member 3 through the lock module 2, and then move the lock module 2 along the cord member 3 into abutment against the upright member 42 of the connection device 4, and then rotate the rotary knob 27 to lower the tightening up screw 26 to the position where the tightening up screw 26 holds down the cord member 3 tightly, and then release the lock pin 23, enabling the latch tongue 232 to be forced by the spring member 24 into engagement with the neck 273 of the rotary knob 27, and then rotate the rotating discs 221 out of the combination. Thus, the locking operation is down.

Figure 11:
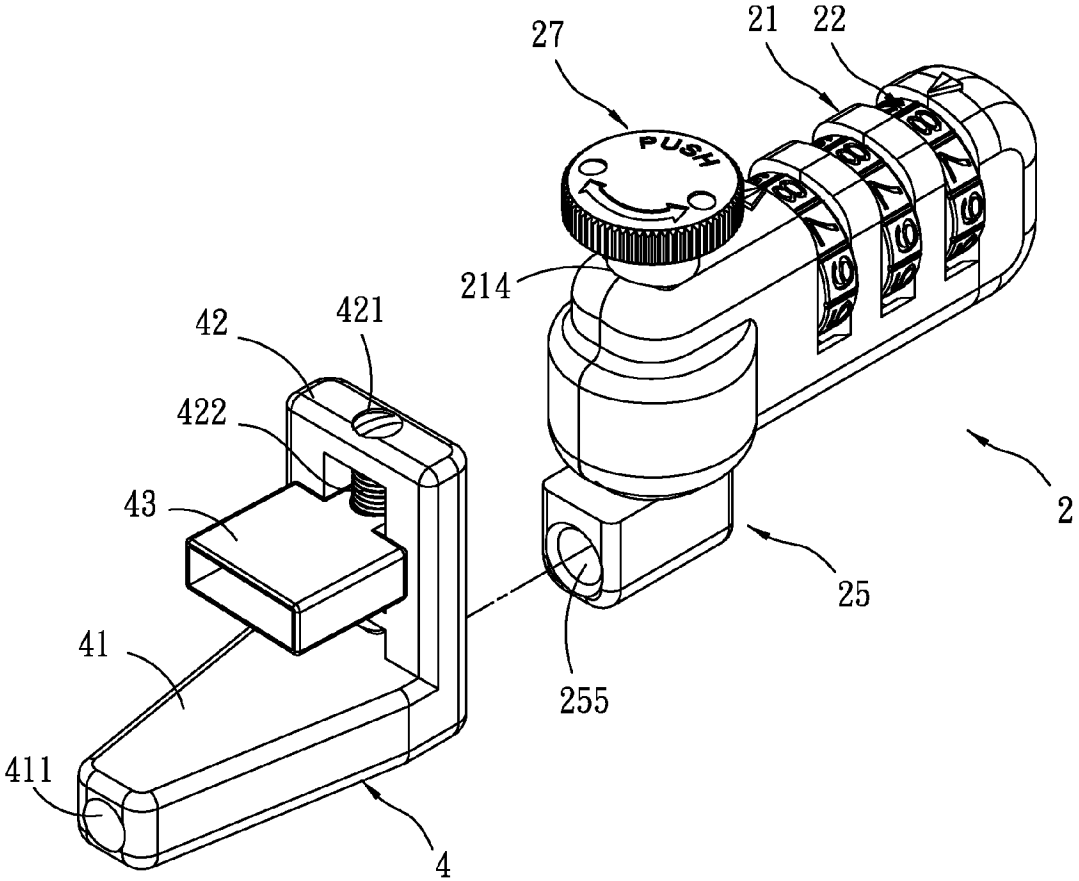
FIG. 11 is an elevational view of a part of locking device in accordance with a fourth embodiment of the present invention.

FIG. 11 is an elevational view of a part of a locking device in accordance with a fourth embodiment of the present invention. This fourth embodiment is substantially similar to the aforesaid third embodiment with the exception that the plug member 43 according to this fourth embodiment is configured subject to the specification of a USB plug for insertion into a USB jack.

Figure 12:
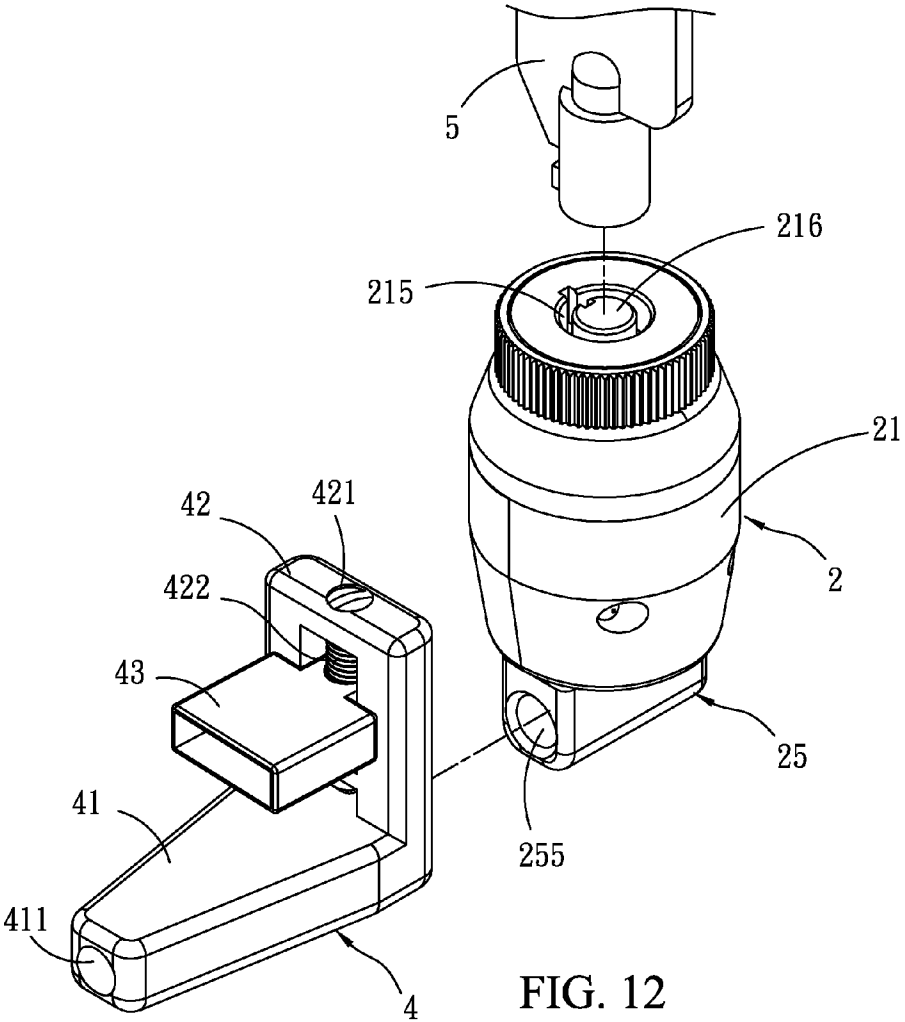
FIG. 12 is an exploded view of a part of locking device in accordance with a fifth embodiment of the present invention.
Figure 13:
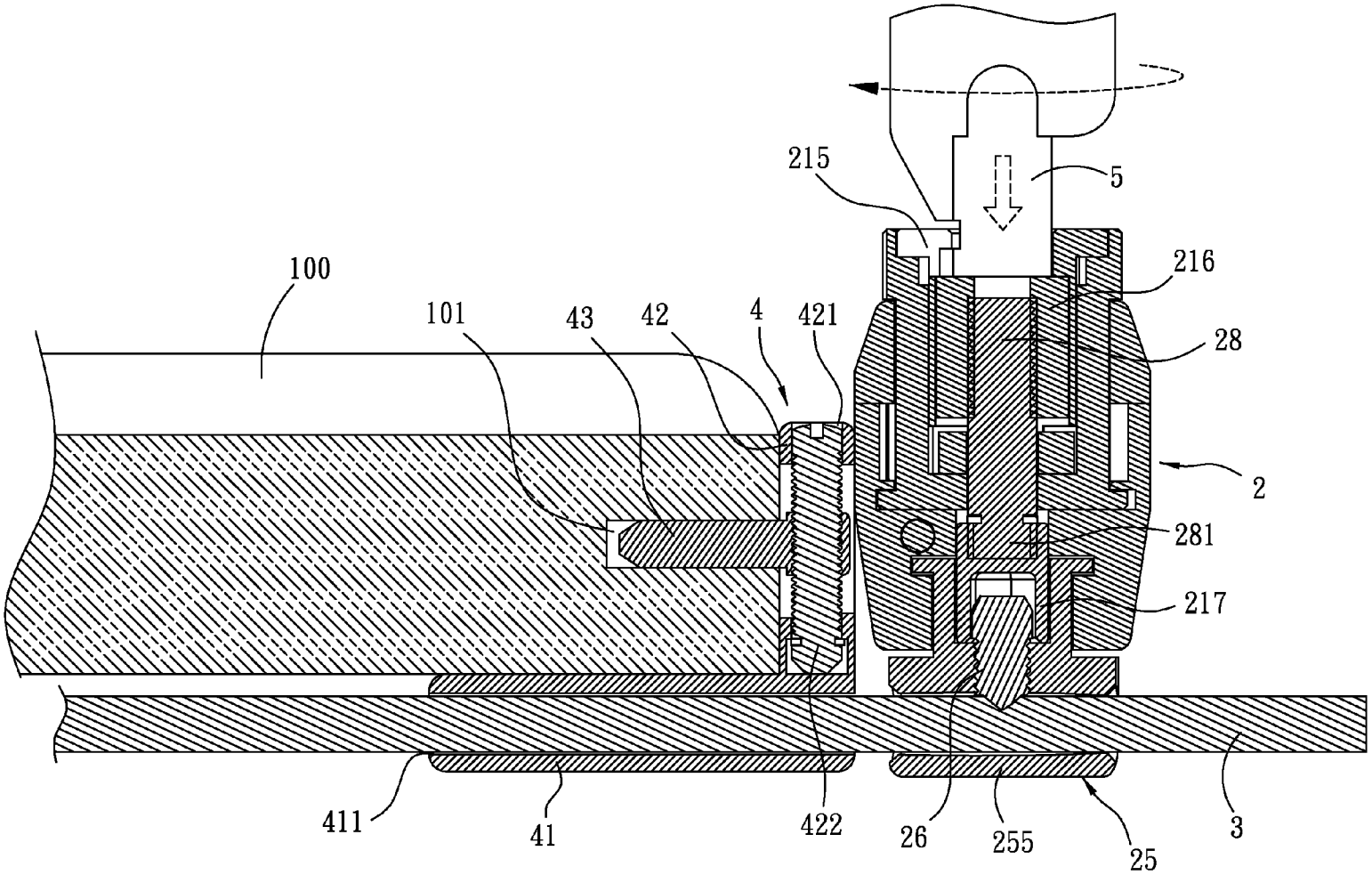
FIG. 13 is a schematic sectional applied view of a part of the locking device in accordance with the fifth embodiment of the present invention.

FIGS. 12 and 13 illustrate a locking device in accordance with a fifth embodiment of the present invention. This fifth embodiment is substantially similar to the aforesaid fourth embodiment with the exception that the lock module 2 of this fifth embodiment is made in the form of a cylinder lock, i.e., the lock module 2 comprises a housing 21 having a keyway 215 located at a top side thereof, a locating block 25 connected to a bottom side of the housing 21 and defining a horizontally extending cord insertion hole 255 outside the housing 21 for the insertion of the cord member 3, a core 261 mounted in the keyway 215, a bolt 28 coupled to and rotatable by the core 261, a socket 217 connected to a bottom connection end piece 281 of the bolt 28, and a tightening up screw 26 mounted in the locating block 25 and rotatable by the socket 217 in direction toward or away from the cord member 3 in the horizontally extending cord insertion hole 255. The user can insert the key 5 into the keyway 215 to rotate the core 216 driving the socket 217 to move the tightening up screw 26 toward or away from the cord member 3 to lock the cord member 3 to the locating block 25, or to release the cord member 3.

Figure 14:
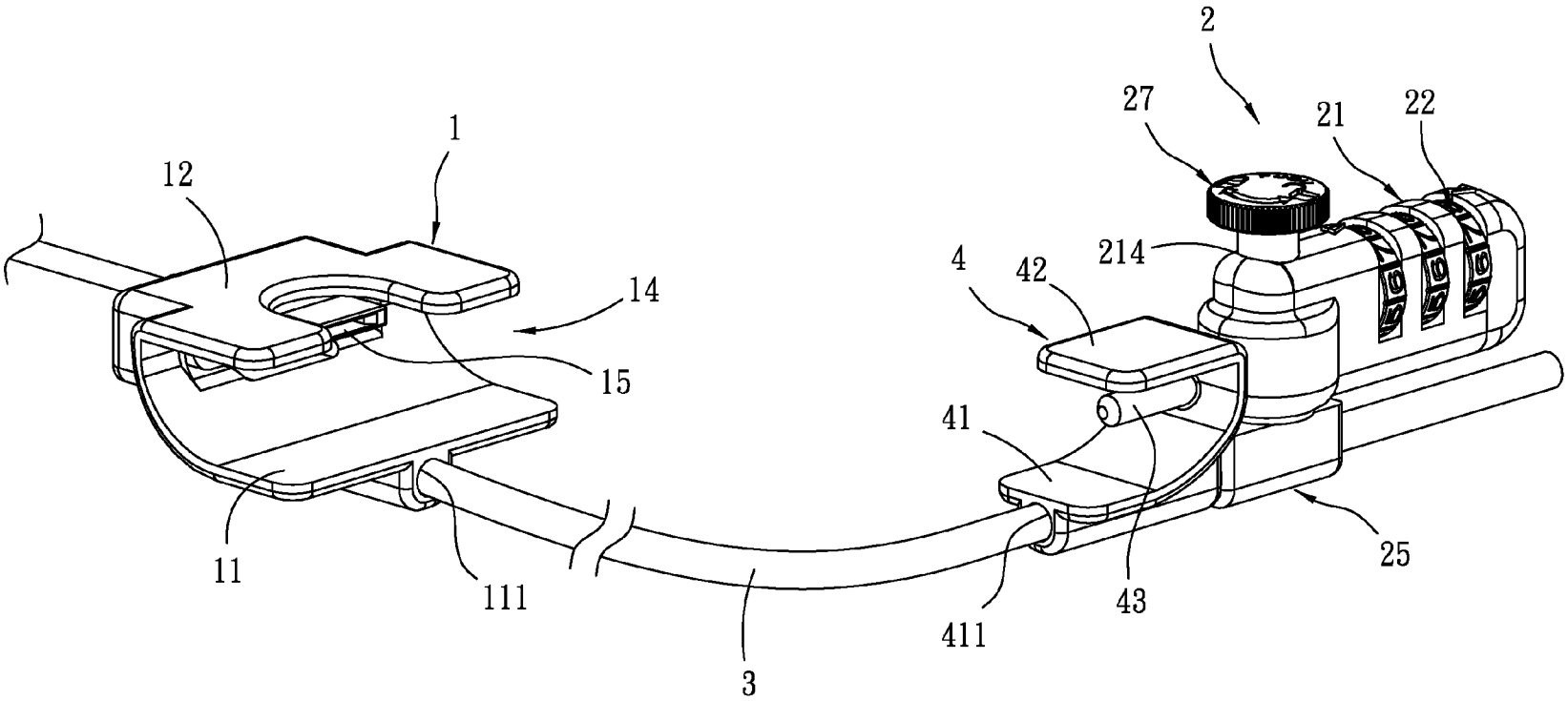
FIG. 14 is an elevational view of a locking device in accordance with a sixth embodiment of the present invention.
Figure 15:
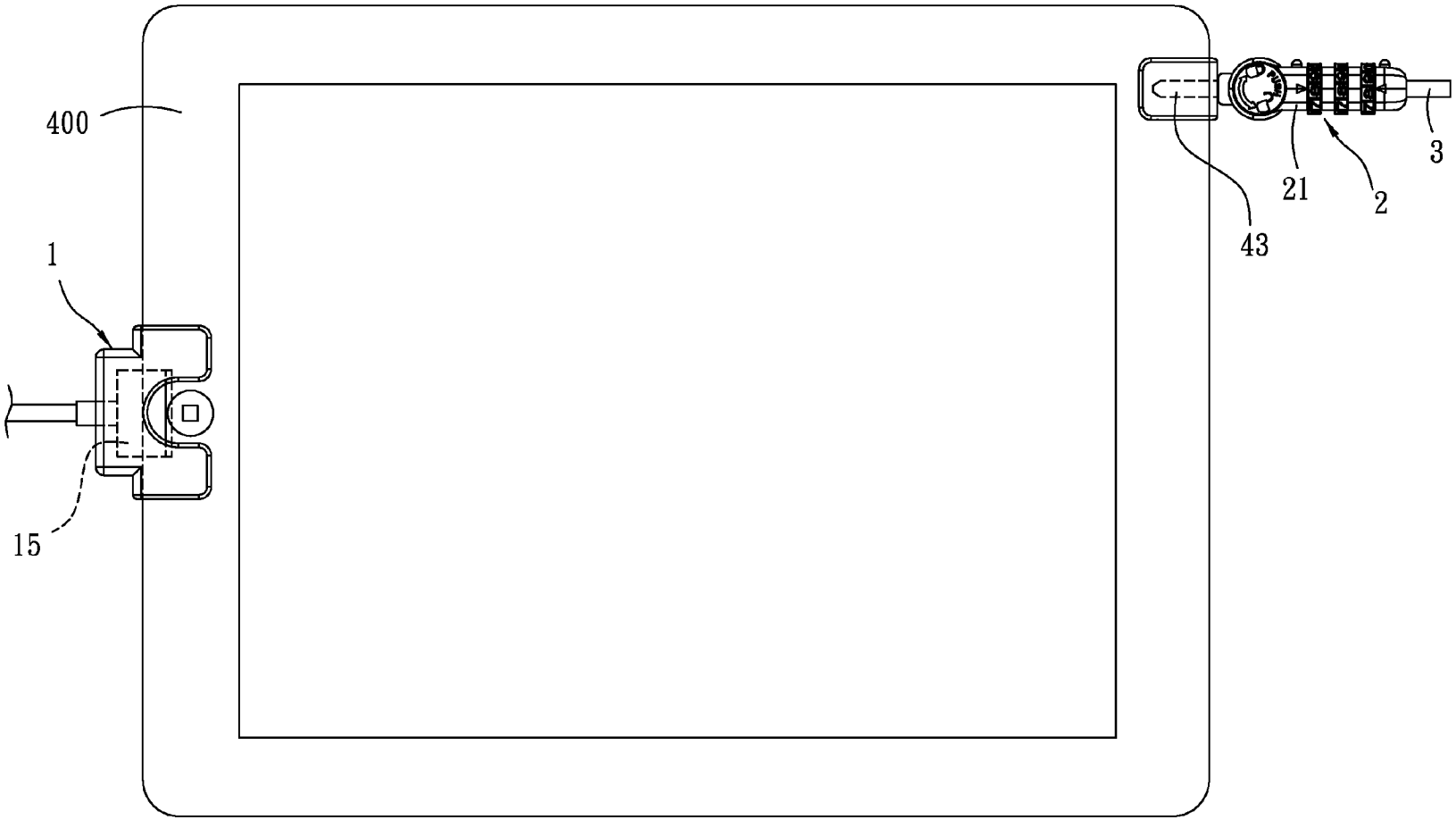
FIG. 15 is an applied view of the locking device in accordance with the sixth embodiment of the present invention.

FIGS. 14 and 15 illustrate a locking device in accordance with a sixth embodiment of the present invention. According to this sixth embodiment, the locking device is adapted for locking a tablet PC 400; the clamp 1 further comprises a plug member 15 that can be configured subject to the specification of a USB plug or ipad 30 pin connector for insertion into a USB jack or 30 pin jack of the tablet PC 400; the plug member 254 of the lock module 43 is adapted for insertion into the audio jack of the tablet PC 400. After the lock module 2 is locked to the cord member 3 at the selected location, the tablet PC 400 is locked in place by the locking device.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A locking device mountable at opposing first and second sides of a mobile electronic device to lock the mobile electronic device, the locking device comprising:

a clamp comprising a cord mounting hole horizontally disposed near a bottom side thereof and comprising a first clamp member comprising a lower part defining therein said cord mounting hole, a vertical insertion slot vertically disposed in an rimmed upper part thereof, and a horizontal screw hole, extending through a front wall of said rimmed upper part in communication with said vertical insertion slot;

a second clamp member movably coupled to said first clamping member and defining with said first clamping member a clamping space, said second clamp member comprising a downwardly extending plug plate movably insertable into said vertical insertion slot of said first clamp member, and a plurality of recessed holes vertically arranged on a front wall of said downwardly extending plug plate; and a lock screw mounted in said horizontal screw hole of said first clamp member and selectively engageable into one said recessed hole of said second clamp member to lock said second clamp member to said first clamp member in one of a series of elevations so that to change a height of the clamping space;

a cord member having one end thereof fastened to said cord mounting hole of said clamp and an opposite end thereof detachably connectable to a lock module;

the lock module attached to and movable along the opposite end of said cord member, said lock module comprising a plug member insertable into the second side of said mobile electronic device, a cord insertion hole for the passing of said cord member, and a stepped through hole disposed in communication with said cord insertion hole; and a tightening up screw mounted in said stepped through hole of said lock module and rotatable relative to said stepped through hole toward and away from said cord member in said cord insertion hole between a locking position to hold down said cord member in said cord insertion hole tightly and an unlocking position for allowing said cord member to be moved relative to said lock module.

2. The locking device as claimed in claim 1, wherein said lock module further comprises:

a housing comprising a plurality of wheel seats arranged in parallel and spaced along a longitudinal axis thereof, an accommodation open chamber located at a bottom wall of a front side thereof and disposed at a front side relative to said wheel seats, a shank hole vertically upwardly extended from said accommodation open chamber to a top wall thereof, and a circular sliding slot transversely disposed at the front side of said housing in communication between said accommodation open chamber and said shank hole;

a rotating disc assembly comprising a plurality of rotating discs respectively marked with the ten digits 0 to 9 around the periphery and respectively accommodated in said wheel seats in said housing and rotatable in the respective wheel seats, a lock pin slot axially extending through the center of each said rotating disc, and a plurality of notches respectively located on a respective inner perimeter of each of said rotating discs in communication with said lock pin slot, said rotating discs being rotatable to correspond to the numerals in a predetermined combination to keep said notches in alignment;

a lock pin inserted into said rotating disc assembly, said lock pin comprising a plurality of protruding teeth protruded from the periphery thereof for mating with said notches of said rotating disc assembly and a latch tongue located at one end thereof outside said rotating disc assembly;

a spring member sleeved onto said lock pin and stopped between said rotating disc assembly and said latch tongue of said lock pin;

a locating block mounted in the front side of said housing, said locating block comprising a rimmed upper part rotatably coupled to said circular sliding slot of said housing and suspending in said accommodation open chamber and a lower part connected to a bottom side of said rimmed upper part and suspending outside said housing, said rimmed upper part defining therein said stepped through hole and fixedly connected with one end of said plug member, said lower part defining therein said cord insertion hole; and a rotary knob comprising a shank inserted into said shank hole of said housing, a socket located at one end of said shank and disposed inside said shank hole for rotating said tightening up screw, a head located at an opposite end of said shank and disposed outside said housing for operation by a user to rotate said shank and said socket, and a neck connected between said shank and said socket and stoppable by said latch tongue of said lock pin.

3. The locking device as claimed in claim 1, wherein said plug member is configured subject to the specification of one of 3.5 mm audio pin and USB plug.

4. The locking device as claimed in claim 1, wherein said first clamp member and said second clamp member both have a substantially L-shaped profile.

5. A locking device mountable at opposing first and second sides of a mobile electronic device to lock the mobile electronic device, the locking device comprising:

a clamp comprising a cord mounting hole horizontally disposed near a bottom side thereof and comprising a first clamp member comprising a lower part defining therein said cord mounting hole, a vertical insertion slot vertically disposed in an rimmed upper part thereof, and a horizontal screw hole, extending through a front wall of said rimmed upper part in communication with said vertical insertion slot;

a second clamp member movably coupled to said first clamping member and defining with said first clamping member a clamping space, said second clamp member comprising a downwardly extending plug plate movably insertable into said vertical insertion slot of said first clamp member, and a plurality of recessed holes vertically arranged on a front wall of said downwardly extending plug plate; and a lock screw mounted in said horizontal screw hole of said first clamp member and selectively engageable into one said recessed hole of said second clamp member to lock said second clamp member to said first clamp member in one of a series of elevations so that to change a height of the clamping space;

a cord member having one end thereof fastened to said cord mounting hole of said clamp and an opposite end thereof detachably connectable to a lock module;

the lock module attached to and movable along the opposite end of said cord member, said lock module comprising a cord insertion hole for the passing of said cord member, and a stepped through hole disposed in communication with said cord insertion hole;

a tightening up screw mounted in said stepped through hole of said lock module and rotatable relative to said stepped through hole toward and away from said cord member in said cord insertion hole between a locking position to hold down said cord member in said cord insertion hole tightly and an unlocking position for allowing said cord member to be moved relative to said lock module; and a connection device set between said clamp and said lock module, said connection device comprising a base member, a horizontal cord hole extending through two opposing ends of said base member for the passing of said cord member, an upright member perpendicularly upwardly extended from one end of said base member, and a horizontal plug member connected to said upright member.

6. The locking device as claimed in claim 5, wherein said lock module further comprises:

a housing comprising a plurality of wheel seats arranged in parallel and spaced along a longitudinal axis thereof, an accommodation open chamber located at a bottom wall of a front side thereof and disposed at a front side relative to said wheel seats, and a shank hole vertically upwardly extended from said accommodation open chamber to a top wall thereof;

a rotating disc assembly comprising a plurality of rotating discs respectively marked with the ten digits 0 to 9 around the periphery and respectively accommodated in said wheel seats in said housing and rotatable in the respective wheel seats, a lock pin slot axially extending through the center of each said rotating disc, and a plurality of notches respectively located on a respective inner perimeter of each of said rotating discs in communication with said lock pin slot, said rotating discs being rotatable to correspond to the numerals in a predetermined combination to keep said notches in alignment;

a lock pin inserted into said rotating disc assembly, said lock pin comprising a plurality of protruding teeth protruded from the periphery thereof for mating with said notches of said rotating disc assembly and a latch tongue located at one end thereof outside said rotating disc assembly;

a locating block mounted in the front side of said housing, said locating block comprising a rimmed upper part rotatably coupled to said accommodation open chamber of said housing and a lower part connected to a bottom side of said rimmed upper part and suspending outside said housing, said rimmed upper part defining therein said stepped through hole, said lower part defining therein said cord insertion hole; and a rotary knob comprising a shank inserted into said shank hole of said housing, a socket located at one end of said shank and disposed inside said shank hole for rotating said tightening up screw, a head located at an opposite end of said shank and disposed outside said housing for operation by a user to rotate said shank and said socket, and a neck connected between said shank and said socket and stoppable by said latch tongue of said lock pin.

7. The locking device as claimed in claim 5, wherein said lock module further comprises a housing defining a keyway at a top side thereof, a locating block connected to a bottom side of said housing and defining a horizontally extending cord insertion hole outside said housing for the passing of said cord member, a core mounted in said keyway, a bolt coupled to and rotatable by said core in said housing, a socket connected to a bottom connection end piece of said bolt inside said housing, and a key insertable into said keyway for rotating said core; said tightening up screw is mounted in said locating block and rotatable by said socket in direction toward or away from said cord member in said horizontally extending cord insertion hole.

8. The locking device as claimed in claim 5, wherein said horizontal plug member is configured subject to the specification of one of 3.5 mm audio pin and USB plug.

9. The locking device as claimed in claim 5, wherein said first clamp member and said second clamp member both have a substantially L-shaped profile.

10. The locking device as claimed in claim 5, wherein said clamp further comprises a plug member extended from an inner wall thereof.

11. The locking device as claimed in claim 10, wherein the plug member of said clamp is configured subject to the is specification of one of 3.5 mm audio pin and USB plug.

12. The locking device as claimed in claim 5, wherein said connection device has a substantially L-shaped profile.

13. The locking device as claimed in claim 5, wherein said connection device further comprises a mounting screw hole vertically formed in said upright member and extending to a top side of said upright member, and an adjustment screw mounted in said mounting screw hole and threaded through one end of said horizontal plug member to secure said horizontal plug member to said upright member and rotatable to move said horizontal plug member along said upright member.

14. A locking device mountable at opposing first and second sides of a mobile electronic device to lock the mobile electronic device, the locking device comprising:

a clamp comprising a cord mounting hole horizontally disposed near a bottom side thereof;

a cord member having one end thereof fastened to said cord mounting hole of said clamp and an opposite end thereof detachably connectable to a lock module;

the lock module attached to and movable along the opposite end of said cord member, said lock module comprising a plug member insertable into the second side of said mobile electronic device, a cord insertion hole for the passing of said cord member, and a stepped through hole disposed in communication with said cord insertion hole; and a tightening up screw mounted in said stepped through hole of said lock module and rotatable relative to said stepped through hole toward and away from said cord member in said cord insertion hole between a locking position to hold down said cord member in said cord insertion hole tightly and an unlocking position for allowing said cord member to be moved relative to said lock module, wherein said lock module further comprises:

a housing comprising a plurality of wheel seats arranged in parallel and spaced along a longitudinal axis thereof, an accommodation open chamber located at a bottom wall of a front side thereof and disposed at a front side relative to said wheel seats, a shank hole vertically upwardly extended from said accommodation open chamber to a top wall thereof, and a circular sliding slot transversely disposed at the front side of said housing in communication between said accommodation open chamber and said shank hole;

a rotating disc assembly comprising a plurality of rotating discs respectively marked with the ten digits 0 to 9 around the periphery and respectively accommodated in said wheel seats in said housing and rotatable in the respective wheel seats, a lock pin slot axially extending through the center of each said rotating disc, and a plurality of notches respectively located on a respective inner perimeter of each of said rotating discs in communication with said lock pin slot, said rotating discs being rotatable to correspond to the numerals in a predetermined combination to keep said notches in alignment;

a lock pin inserted into said rotating disc assembly, said lock pin comprising a plurality of protruding teeth protruded from the periphery thereof for mating with said notches of said rotating disc assembly and a latch tongue located at one end thereof outside said rotating disc assembly;

a spring member sleeved onto said lock pin and stopped between said rotating disc assembly and said latch tongue of said lock pin;

a locating block mounted in the front side of said housing, said locating block comprising a rimmed upper part rotatably coupled to said circular sliding slot of said housing and suspending in said accommodation open chamber and a lower part connected to a bottom side of said rimmed upper part and suspending outside said housing, said rimmed upper part defining therein said stepped through hole and fixedly connected with one end of said plug member, said lower part defining therein said cord insertion hole; and a rotary knob comprising a shank inserted into said shank hole of said housing, a socket located at one end of said shank and disposed inside said shank hole for rotating said tightening up screw, a head located at an opposite end of said shank and disposed outside said housing for operation by a user to rotate said shank and said socket, and a neck connected between said shank and said socket and stoppable by said latch tongue of said lock pin.

* * * * *